US005569132A

United States Patent [19]

Wu

[11] Patent Number: 5,569,132

[45] Date of Patent: Oct. 29, 1996

[54] FOLDABLE HORSE RIDING TYPE EXERCISER

[76] Inventor: Tien-Lai Wu, 58, Ma Yuan West St., Taichung, Taiwan

[21] Appl. No.: 405,821

[22] Filed: Mar. 6, 1995

[51] Int. Cl.[6] ..... A63B 69/06

[52] U.S. Cl. ..... 482/96; 482/95; 482/72

[58] Field of Search ..... 482/95, 130, 96, 482/137, 57, 71, 72; 472/51, 111, 106, 110

[56] References Cited

U.S. PATENT DOCUMENTS

| | | | |
|---|---|---|---|
| 5,366,428 | 11/1994 | Liao | 482/96 |
| 5,370,594 | 12/1994 | Grinblat | 482/72 |
| 5,421,795 | 6/1995 | Chen | 482/96 |
| 5,429,568 | 7/1995 | Chen | 482/57 |
| 5,458,553 | 10/1995 | Wu . | |
| 5,464,378 | 11/1995 | Yu | 482/95 |

FOREIGN PATENT DOCUMENTS

| | | | |
|---|---|---|---|
| 0498342 | 5/1930 | Germany | 482/72 |

*Primary Examiner*—Jerome Donnelly

[57] ABSTRACT

An exerciser includes a base and a seat post pivotally coupled to the base. A link has a lower end pivotally coupled to the base and has a roller engaged in the upper end for engaging with the bottom surface of the seat post so as to elevate the seat post when the link is rotated. A handle is pivotally coupled to the base and pivotally coupled to the link by a lever. The seat post is rotated by the handle in order to conduct horse riding type exercise. The exerciser may be folded to a rather compact configuration for storing and for transportation purposes.

1 Claim, 8 Drawing Sheets

FOLDABLE HORSE RIDING TYPE EXERCISER

BACKGROUND OF THE INVENTION

1. Field of the Invention

The present invention relates to an exerciser, and more particularly to a foldable horse riding type exerciser.

2. Description of the Prior Art

Typical horse riding type exercisers comprise a large volume that may not be folded to a small volume such that the exercisers are not good for storing and for transportation purposes.

The present invention has arisen to mitigate and/or obviate the afore-described disadvantages of the conventional horse riding type exercisers.

SUMMARY OF THE INVENTION

The primary objective of the present invention is to provide a horse riding type exerciser which may be folded to a rather compact configuration that is excellent for storing and for transportation purposes.

In accordance with one aspect of the invention, there is provided an exerciser comprising a first beam including a rear and lower portion, a front and upper portion and a middle portion having a support rod provided thereon, a second beam including a front and lower portion and including a rear and upper portion pivotally coupled to the middle portion of the first beam, securing means for securing the rear and upper portion of the second beam to the first beam so as to form a stable base, a seat post including a first end pivotally coupled to the middle portion of the first beam and including a bottom surface, the seat post being engaged with the support rod so as to be disengaged from the first beam, a link including a lower end pivotally coupled to the middle portion of the first beam and including an upper end having a roller rotatably secured thereon for engaging with the bottom surface of the seat post so as to elevate the seat post when the link is rotated, the link including a middle portion, a handle including a middle portion pivotally coupled to the front and upper portion of the first beam and including a lower portion having a foot support means secured thereto, a lever including a first end pivotally coupled to the middle portion of the link and including a second end, and pivot shaft means pivotally coupling the second end of the lever to the lower portion of the handle so as to pivotally couple the second end of the lever to the handle. The seat post is rotated by the handle in order to elevate the seat post so as to conduct horse riding type exercise. The seat post is engaged with the first beam when the support rod is disengaged from the first beam. The handle is rotatable relative to the first beam when the pivot shaft means is disengaged from the handle. The second beam is rotatable relative to the first beam when the securing means is disengaged from the first beam.

The exerciser may be folded to a rather compact configuration which is excellent for storing and for transportation purposes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
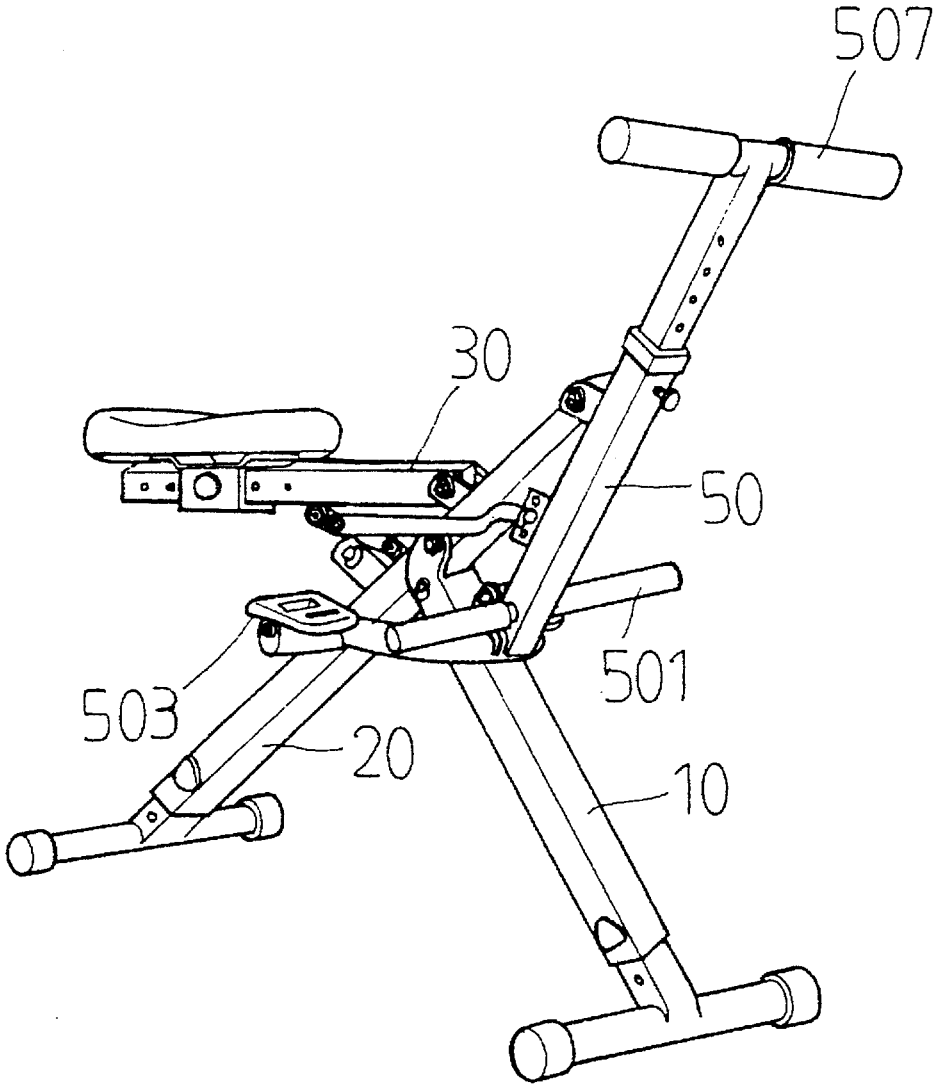
FIG. 1 is a perspective view of a foldable horse riding type exerciser in accordance with the present invention.
Figure 2A:
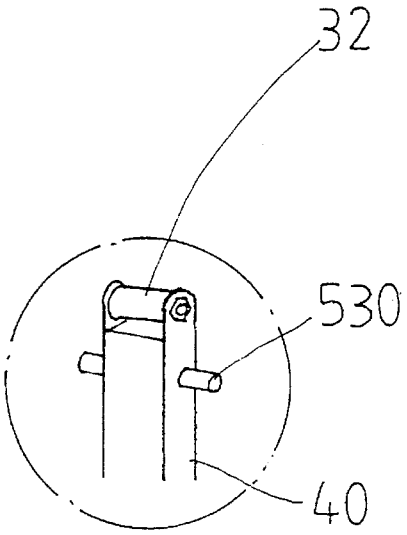
FIG. 2A is a partial perspective view showing a coupling portion of the exerciser.
Figure 2:
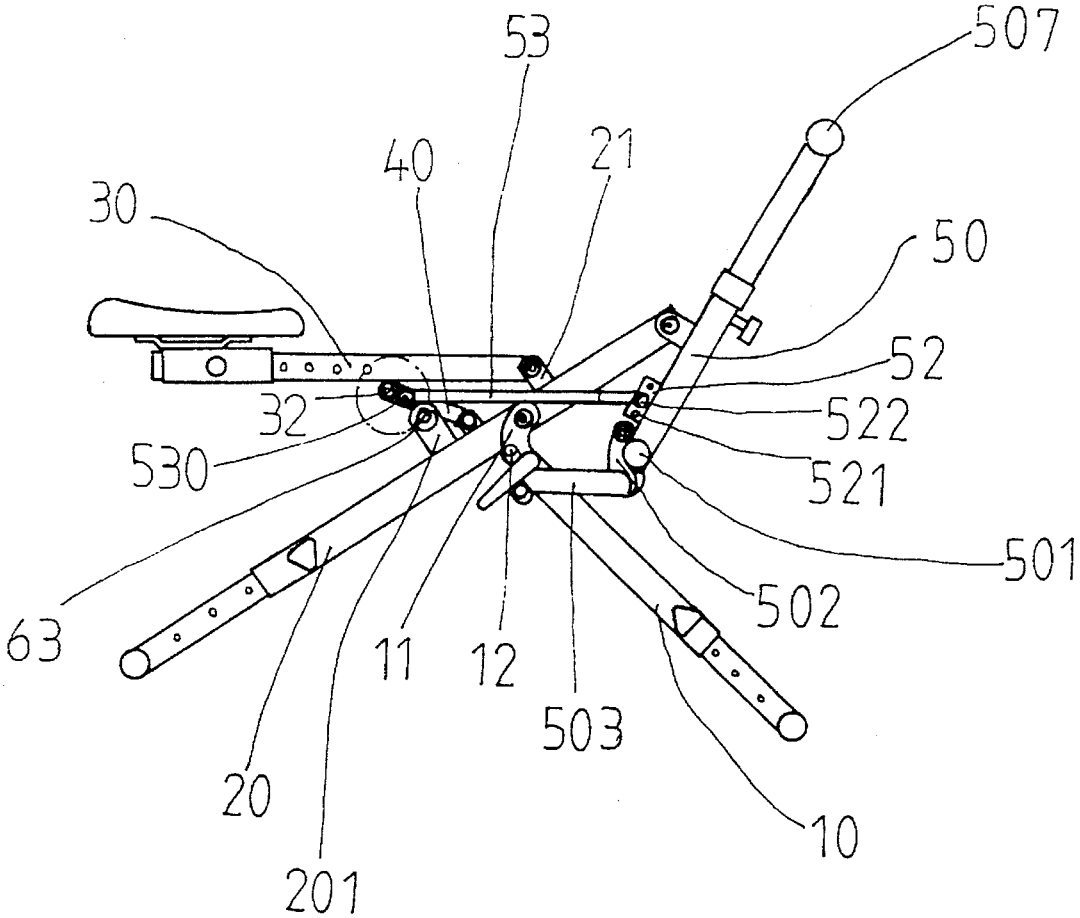
FIG. 2 is a side view of the horse riding type exerciser.
Figures 3, 3A, 3B:
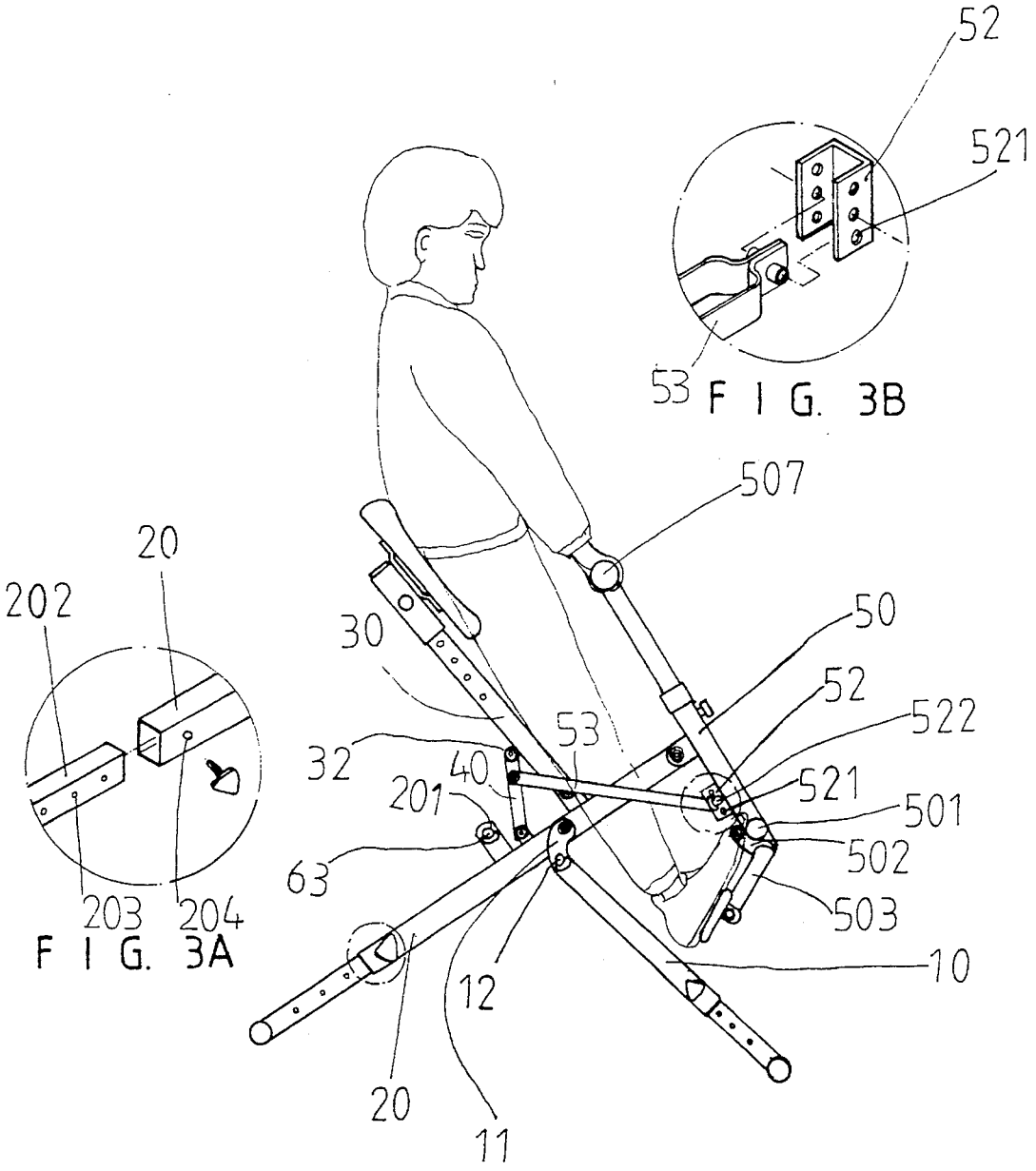
FIGS. 3 and 4 are side views of the horse riding type exerciser, illustrating the operation of the exerciser.
FIGS. 3A and 3B are partial perspective views showing the coupling portions of the exerciser.

Referring to the drawings, and initially to FIGS. 1 to 3, a foldable horse riding type exerciser in accordance with the present invention comprises a first beam 20 extended with suitable slope having a rear and lower portion and an upper and front portion, and a second beam 10 having a front and lower portion and having an upper and rear portion 11 pivotally coupled to the middle portion of the first beam 20. The first beam 20 includes an extension 202 engagable thereon and having screw holes 203 formed therein for aligning with screw holes 204 of the first beam 20 and for engaging with screws which may secure the extension 202 to the first beam 20 (FIG. 3A). A securing means 12 is engaged such as with pin the upper end portion 11 of the first beam 20 so as to secure the upper end portion 11 to the first beam 20 and so as to form a stable base. The first beam 20 includes a pair of ears 201 extended from the middle portion for engaging with a support rod 63 therein.

A seat post 30 includes one end pivotally coupled to a pair of ears 21 which are secured on the front and upper portion of the first beam 20 such that the seat post 30 is rotatable about the ears 21. A link 40 includes a lower end pivotally coupled to the middle portion of the first beam 20 and includes an upper end having a roller 32 (FIG. 2A) rotatably engaged with the seat post 30 and movable along the bottom surface of the seat post 30.

Figure 5:
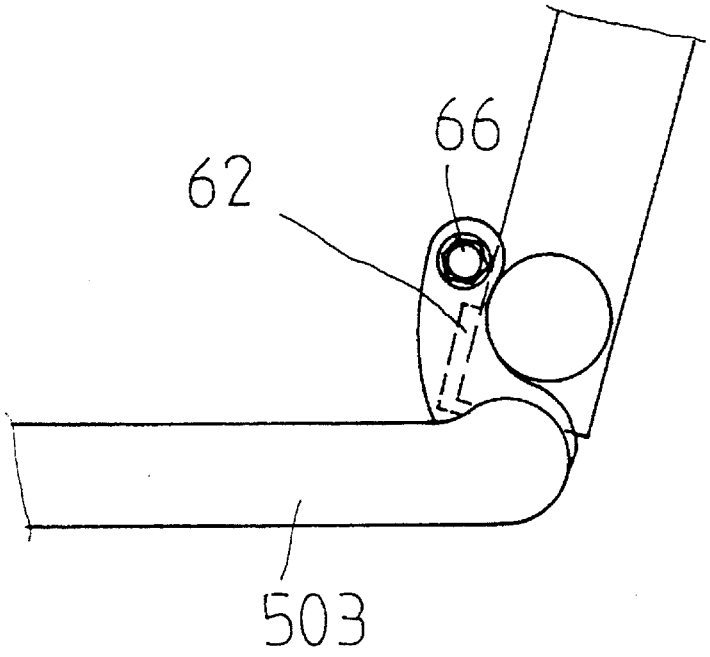
FIG. 5 is a plane view illustrating the coupling portion of the exerciser.

A handle 50 includes a middle portion pivotally coupled to the front and upper portion of the first beam 20, includes a hand grip means 507 provided on top thereof, includes a pair of bars 501 provided in the bottom portion for supporting the feet of the users, and includes a bracket 52 secured to the lower portion and having a number of pairs of holes 521 formed therein. A lever 53 includes one end pivotally coupled to either pair of the holes 521 by pivot shaft 522 (FIGS. 2 and 3B) and includes the other end pivotally coupled to the middle portion of the link 40 by pivot shafts 530 (FIG. 2A); such that the link 40 may be rotated by the handle 50 in order to move the roller 32 along the bottom surface of the seat post 30 and in order to raise the seat post, best shown in FIG. 3. As shown in FIG. 5, a pair of foot pedals 503 are pivotally coupled to the lower end of the handle 50 by pivot shaft 66 and support with a stop means 62. The handle 50 includes a bottom portion having a depression 61 formed therein for engaging with the foot pedals 503 (FIGS. 8 and 9).

Figure 4:
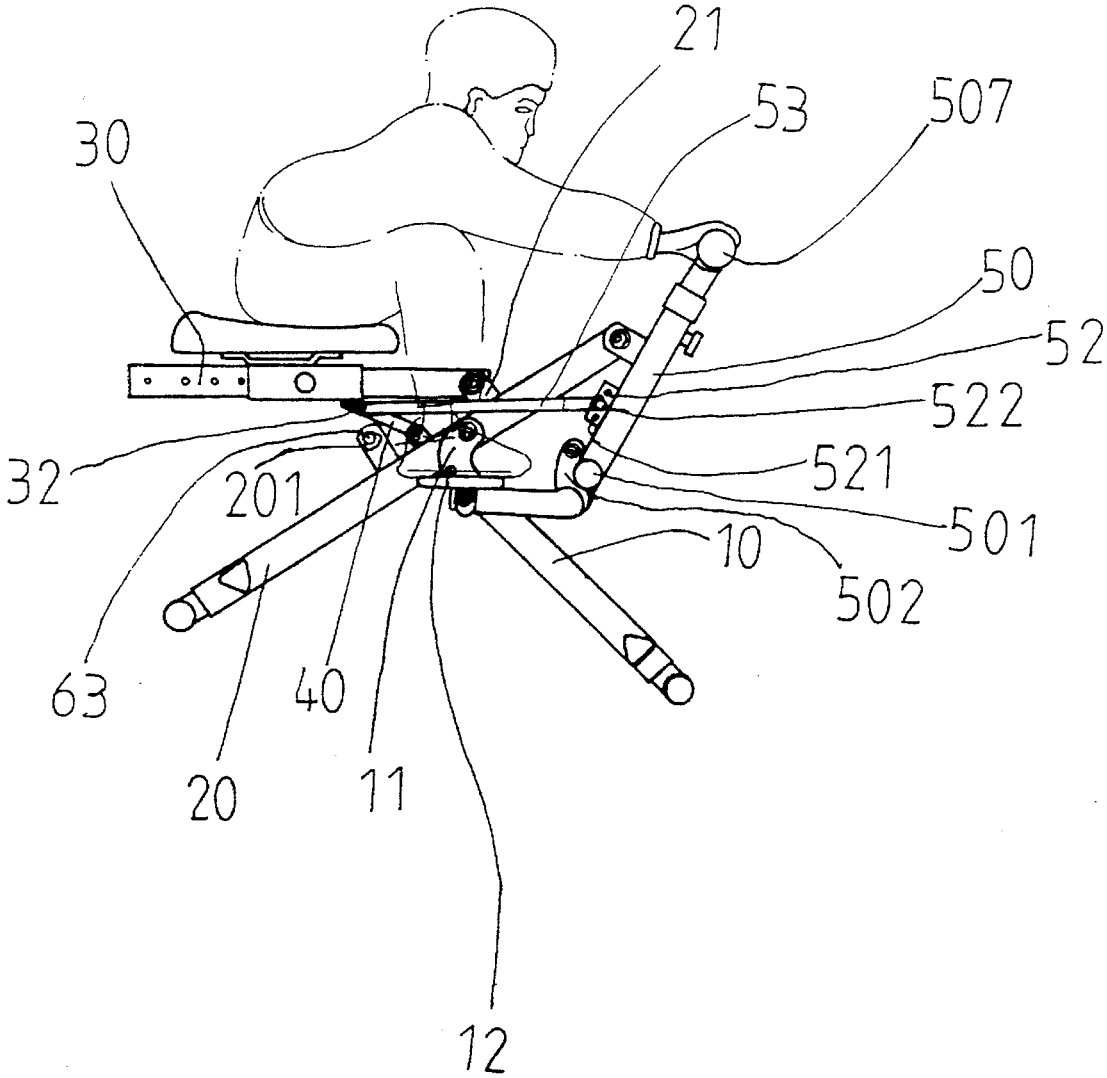

In operation, as shown in FIGS. 3 and 4, when the hand grips 507 are pulled by the users and/or when the foot pedals 503 are forced by the users, the seat post 30 may be elevated in order to simulate horse riding type exercises.

Figure 6:
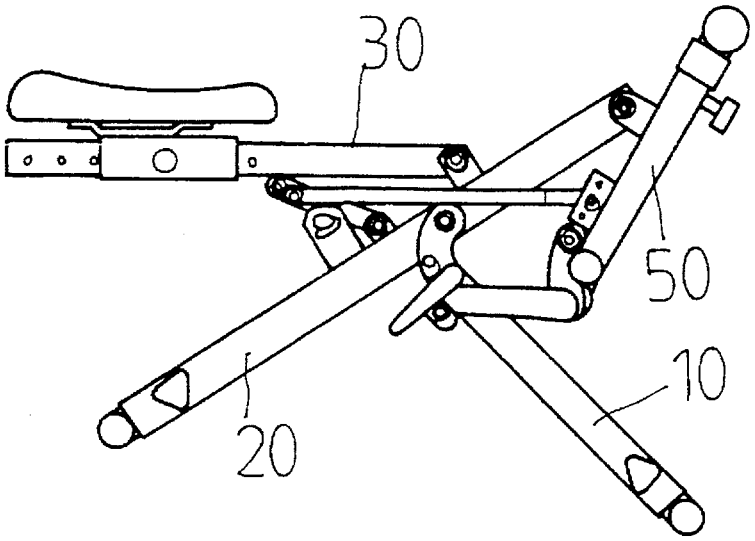
FIGS. 6, 7, 8, 9, 10 are side views showing the folding operation of the foldable horse riding type exercisers.
Figure 7:
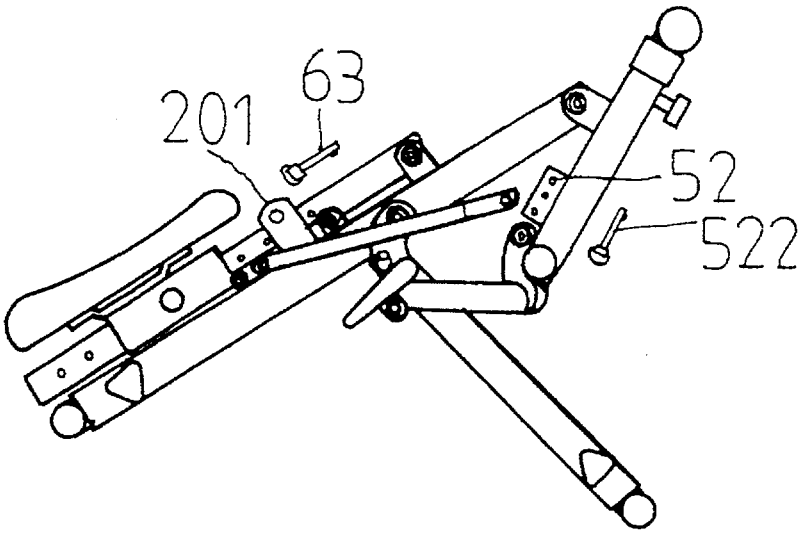
Figure 8:
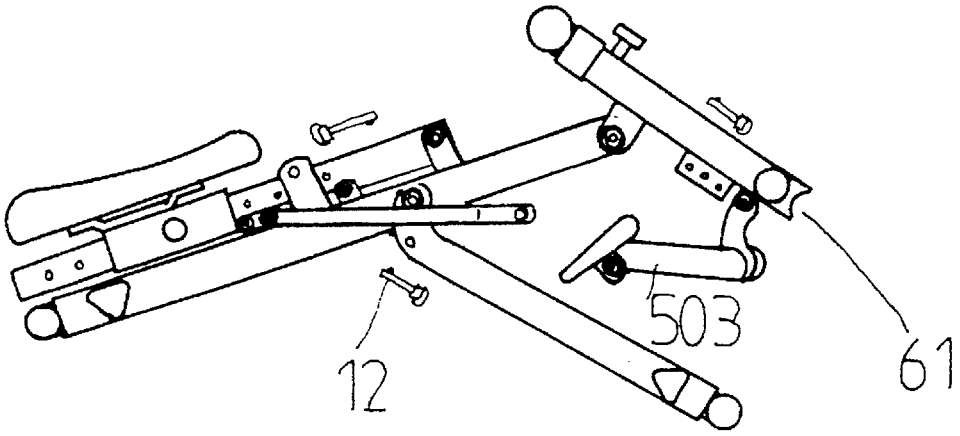
Figure 9:
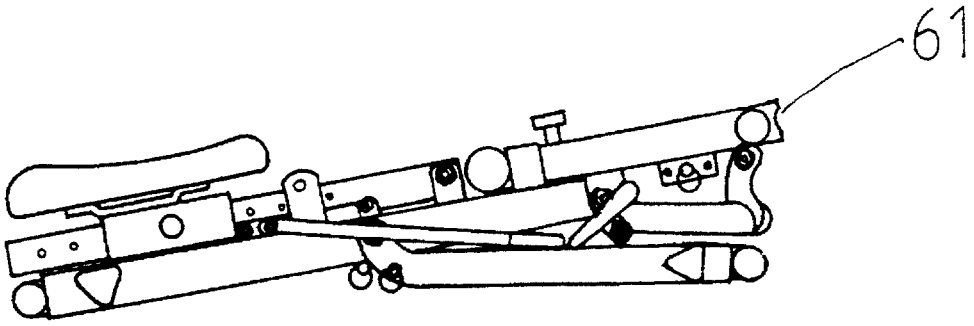
Figure 10:
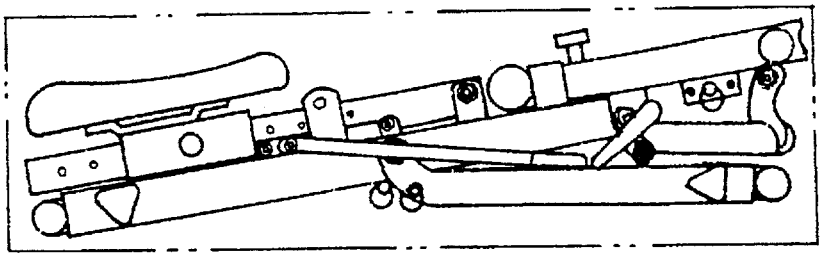

Referring next to FIGS. 6 to 10, when it is required to fold the exerciser, the handle 50 and the beams 10, 20 are first shortened to the shortest configuration (FIG. 6). The support rod 63 is then disengaged from the ears 201 such that the seat post 30 may be folded to engage with the first beam 20, and the pivot shaft 522 is disengaged from the bracket 52 such that the handle 50 may be rotated relative to the first beam 20 (FIG. 7). The foot pedals 503 may then be folded relative to the handle 50. The pin 12 is then disengaged from the beams 10, 20 such that the second beam 10 may be folded to a position substantially aligned with the first beam 10 (FIGS. 8 and 9). The folded exerciser may then be accommodated in and stored within a box or the like (FIG. 10).

Accordingly, the foldable horse riding type exerciser in accordance with the present invention may be folded to a rather compact configuration that is excellent for storing and for transportation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable exerciser comprising a stable base member including first and second inclined beams, said first inclined beam including a rear and lower portion adapted to rest on a support surface, a front and upper portion, and a middle portion having ear members provided thereon which supports a support rod, said second inclined beam including a front and lower portion adapted to rest on a support surface, and a rear and upper portion pivotally coupled to said middle portion of said first inclined beam, securing means for securing said rear and upper portion of said second inclined beam to said first inclined beam so as to form said stable base, a seat post, including a first end pivotally coupled to said middle portion of said first inclined beam and including a bottom surface, said seat post being supported by said support rod to thereby suspend said seat post in a substantially horizontal elevation above said first inclined beam, a link, including a lower end pivotally coupled to said middle portion of said first inclined beam and including an upper end having a roller rotatably secured thereon for rollable engagement with said bottom surface of said seat post so as to elevate said seat post when said link is rotated in a clockwise direction, said link including a middle portion, a handle including a middle portion pivotally coupled to said front and upper portion of said first inclined beam and including a lower portion having a foot support means secured thereto, a lever including a first end pivotally coupled to said middle portion of said link and including a second end, pivot shaft means pivotally coupling said second end of said lever to said lower portion of said handle, said first inclined beam being rotatably displaceable when said handle and said first and second inclined beams are shortened to a shortest configuration, and wherein said support rod is disengaged from said ears in order to fold said seat post to engage with said first inclined beam, said pivot shaft means is disengaged from said second end of said lever, said handle is rotated relative to said first inclined beam, said securing means is disengaged from said first and second inclined beams, and said second inclined beam is folded to a position substantially aligned with said first inclined beam, and whereby said foldable exerciser is folded to a compact configuration to be stored and transported.

* * * * *